United States Patent [19]

Hochen

[11] Patent Number: 5,040,266

[45] Date of Patent: Aug. 20, 1991

[54] GLIDE FRAME APPARATUS

[76] Inventor: Carl G. Hochen, P.O. Box 1113 Rockville, Md. 20850

[21] Appl. No.: 285,643

[22] Filed: Dec. 16, 1988

[51] Int. Cl.[5] ..... E05D 15/00; A47H 13/00

[52] U.S. Cl. ..... 16/87.2; 16/87.8

[58] Field of Search ..... 16/87 R, 87.2, 91, 93 R, 16/87.8

[56] References Cited

U.S. PATENT DOCUMENTS

| | | | |
|---|---|---|---|
| 615,339 | 12/1898 | Berbecker | 16/87 R |
| 872,947 | 12/1907 | Leslie | 16/87 R |
| 1,160,573 | 11/1915 | Byron | 16/87.2 |
| 1,251,483 | 1/1918 | Days | 16/87 R |
| 1,721,338 | 7/1929 | Gaghon | 16/87.8 |
| 2,320,308 | 5/1943 | Silverman | 16/87.2 |
| 3,550,184 | 12/1970 | Hachtel | 16/87.2 |

FOREIGN PATENT DOCUMENTS

| | | | |
|---|---|---|---|
| 61996 | 10/1982 | European Pat. Off. | 16/87.2 |
| 52652 | 6/1942 | Netherlands | 16/87.8 |

*Primary Examiner*—Richard K. Seidel
*Assistant Examiner*—Carmine Cuda

[57] ABSTRACT

A glide frame apparatus is disclosed for supporting a sheet material such as a drapery or curtain, a wall or a door for movement along a rod member, rail or beam. The glide frame comprises a frame for mounting on and movement along the rod member with the frame including a material brace for adjusting the width or length of the frame. Anchor members which are fixed to the sheet material are coupled to the frame such that a portion of the sheet material is thereby attached to the frame by the anchor member. The material brace includes extension arms for slidably mounting the material brace within the frame, this sliding movement being used to expand the size of the frame. A glide frame apparatus further disclosing a pleater device which forms pleats in a drapery fabric without the necessity of sewing. Further, the anchor member and frame are connected together using a ball and socket connection and a receiving member and cylindrical connector arm connection.

14 Claims, 5 Drawing Sheets

GLIDE FRAME APPARATUS

BACKGROUND OF THE INVENTION

The present invention is directed to a glide frame apparatus which is a transporting device that may be used with draperies or curtains to convert a plain curtain rod into a traversing rod for pocketed drapes and curtains while also adding fit and architectural shaping. The present invention may also be used for converting flat materials into multiple pleats along with adding a decorative trim.

The glide frame apparatus may also be used for transporting sheet material such as walls, doors, drawers and panels along a rod, rail or beam.

SUMMARY OF THE INVENTION

It is an object of the present invention to provide a glide frame apparatus for use with draperies or curtains in which a plain curtain rod may be converted into a traversing rod.

It is another object of the present invention to provide a glide frame apparatus which enables a plain drapery or curtain to be pleated by the insertion of a pleater device thereby eliminating sewing.

It is still another object of the present invention to provide a glide frame apparatus which is expandable after being inserted into a rod pocket in the drape or curtain in order to provide a tight fit of the frame in the rod pocket.

It is another object of the present invention to provide a decorative anchor or attaching device for attaching the fabric or sheet material to the frame.

It is still another object of the present invention to provide a ball and socket and washer lock and slot devices for connecting the attaching anchor to the frame.

The present invention is directed to a glide frame apparatus for supporting a sheet material such as a drapery or curtain, a wall or a door for movement along a rod member, rail or beam. The glide frame comprises a frame for mounting on and movement along the rod member with the frame including a material brace for adjusting the width or length of the frame. Anchor members which are fixed to the sheet material are coupled to the frame such that a portion of the sheet material is thereby attached to the frame by the anchor member. The material brace includes extension arms for slidably mounting the material brace within the frame, this sliding movement being used to expand the size of the frame. The present invention also includes a pleater device which forms pleats in a drapery fabric without the necessity of sewing. Further, the anchor member and frame are connected together using a ball and socket connection and a receiving member and cylindrical connector arm connection.

DETAILED DESCRIPTION OF THE PREFERRED EMBODIMENTS

Figure 1:
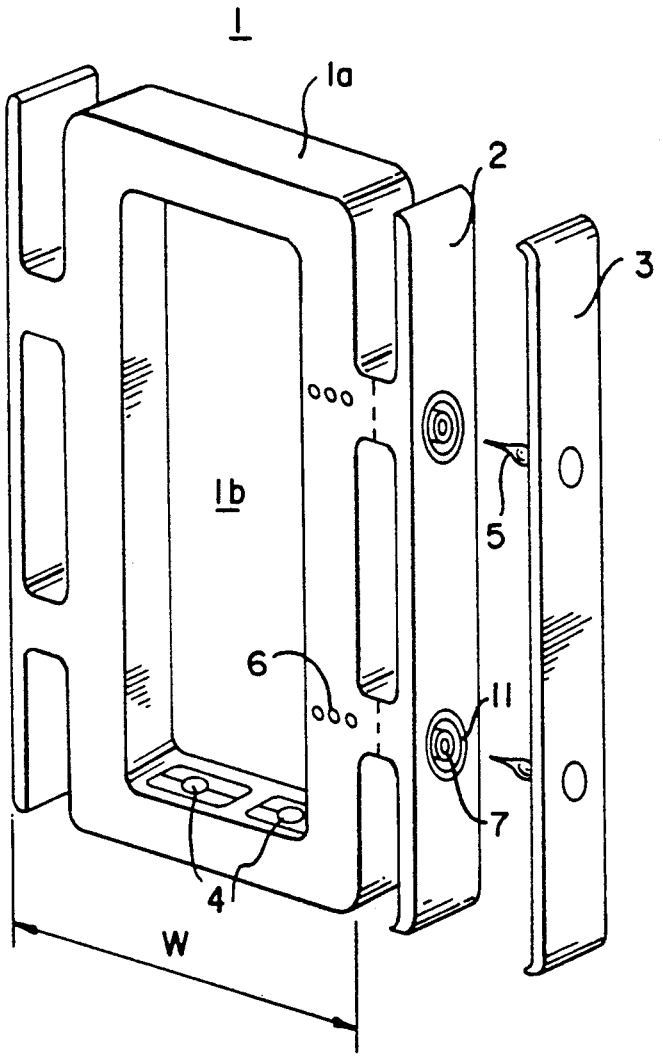
FIG. 1 is a perspective view of a glide frame apparatus of the present invention.

Referring to the drawings, glide frame apparatus 1 comprises a frame member 1*a* having an opening 1*b* in the center thereof. The frame 1*a* is adapted to ride on a rod, rail or beam positioned in the opening 1. Material brace 2 is slidably mounted in frame 1*a* by means of extension arms 18 which are inserted into opening 18*a* in frame 1*a*. Extension arm 18 enables the material brace to be moved away from frame 1*a* thereby expanding dimension w of glide frame 1.

Anchor member 3 is made to be attached to material brace 2 by inserting projection 5 into ports or receiving members in material brace 2. The front face of anchor member 3 can have a decorative surface to enhance the beauty of the glide frame since this surface will be exposed. In the embodiment shown in FIG. 1, projection 5 is a spike and ball. Port 7 includes a socket which receives the ball 5 and holds the ball 5 therein once it is inserted.

Figure 4:
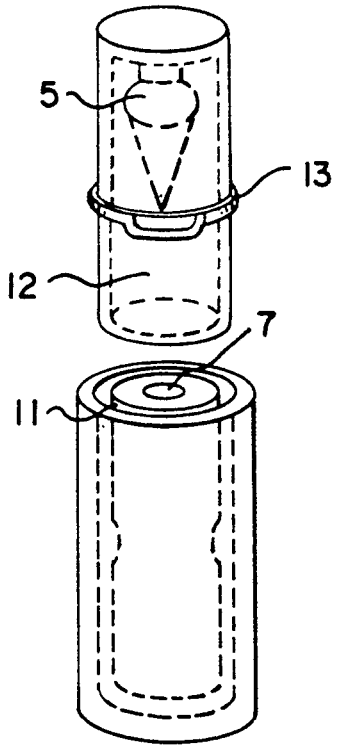
FIG. 4 is a perspective view of an anchor device which attaches to the frame of the present invention.
Figure 5A:
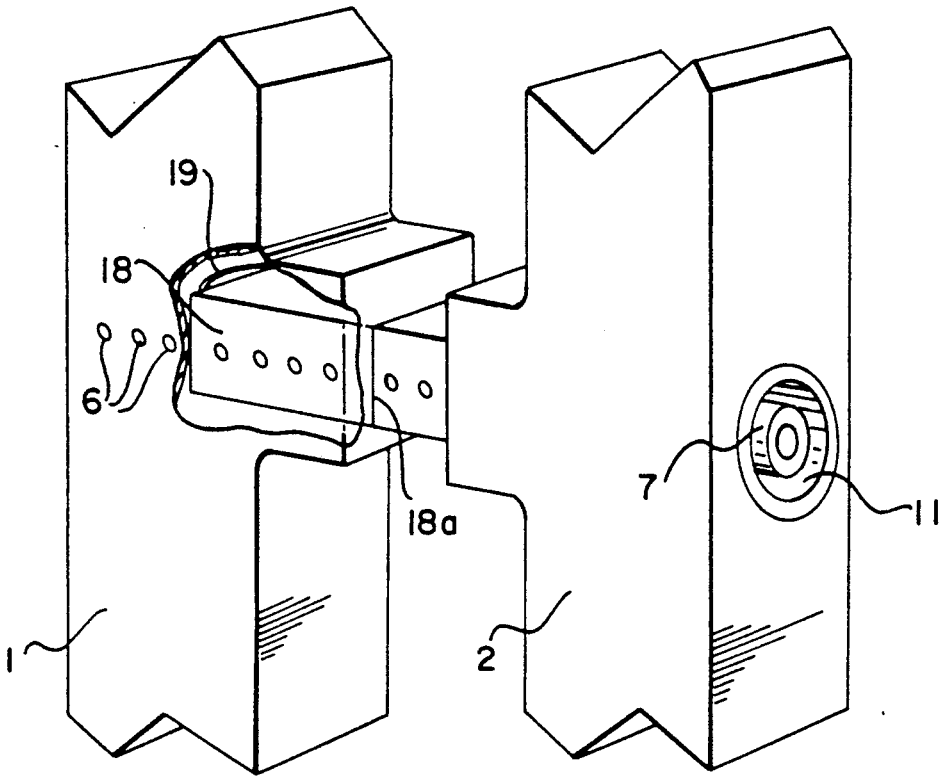
FIG. 5*a* is a perspective view illustrating an extension arm for expanding the frame of the present invention.
Figure 5B:
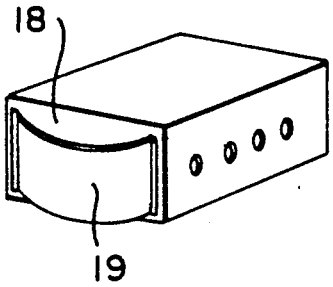
FIG. 5*b* illustrates a spring used to bias the extension arm.

In an alternative embodiment shown in FIG. 4, the projection from the anchor member 3 is a spike and ball 5 which is received in port 7 and a cylindrical connector arm 12 which has a washer lock 13 circumferentially surrounding it. The connector arm 12 is inserted into a cylindrical receiving member which is part of material brace 2. The receiving member includes a cylindrical portion having a connector groove or slot which is engaged by washer lock 13 and also has a port 7 which receives the spike and ball 5.

When assembling the glide frame of the present invention, the frame 1*a* and material brace 2 are inserted into the rod pocket of a drapery or curtain, such that the front of the rod pocket of the drapery or curtain covers the front face of material brace 2. When the glide frame is properly positioned within the rod pocket, anchor member 3 is placed against the front outside face of the rod pocket, so that spike and ball 5 are aligned with port 7. The anchor member 3 is then pushed forward so that the spike passes through the fabric into port 7 until the ball 5 is held in the socket within port 7. The front face of the rod pocket is positioned and held between anchor member 3 and material brace 2.

Any sheet material whether having a rod pocket or not, can be placed between material brace 2 and anchor member 3 after which the anchor member 3 is attached to the glide frame by means of its engagement with material brace 2, to hold the sheet material therebetween. The glide frame 1 can then be placed on a rod, or rail, or beam for movement of the sheet material.

When the glide frame 1 is placed in a rod pocket in a curtain or drapery, material brace 2 can be moved away from frame 1*a* by means of expandable arms 18 in order to provide the proper fit in the rod pocket. Once it is expanded, it can be held in the expanded position by the insertion of a lock in holes 6. Extension arm 18 also includes a spring 19 which engages frame 1*a* in order to bias the material brace away from frame 1*a*.

In the embodiment of FIG. 1, bearings 4 on the upper and lower portions of the frame 1*a* support the frame on the rod in opening 1*b* and enable the glide frame to be moved easily along the rod.

Figure 2:
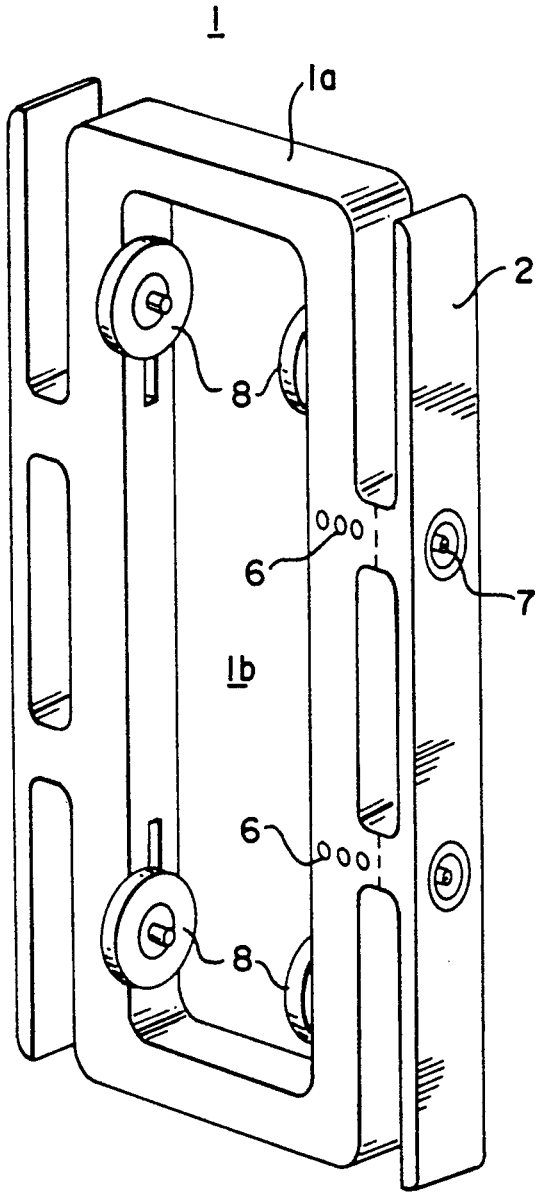
FIG. 2 is a perspective view of another embodiment of the glide frame apparatus of the present invention.

In an alternative embodiment of the glide frame shown in FIG. 2, the bearings comprise spring biased wheels 8 which engage a rod, rail or beam and support the glide frame 1 on the rod, rail or beam. The wheels 8 are located on the front and rear sides of the frame 1*a*.

Figure 3:
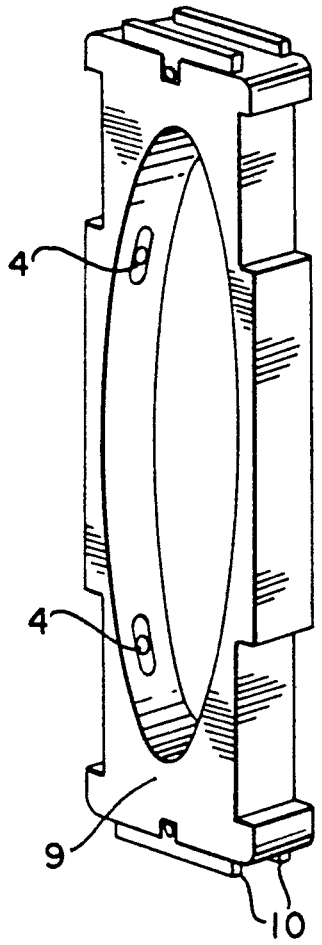
FIG. 3 is a shape converter for the glide frame apparatus of the present invention.

FIG. 3 illustrates a shape converter of the present invention in which the size and shape converter 9 is adapted to be positioned within opening 1*b* of frame 1*a*. Extendable gates 10 hold size and shape converter 9 within the opening 1*b*.

Figure 6C:
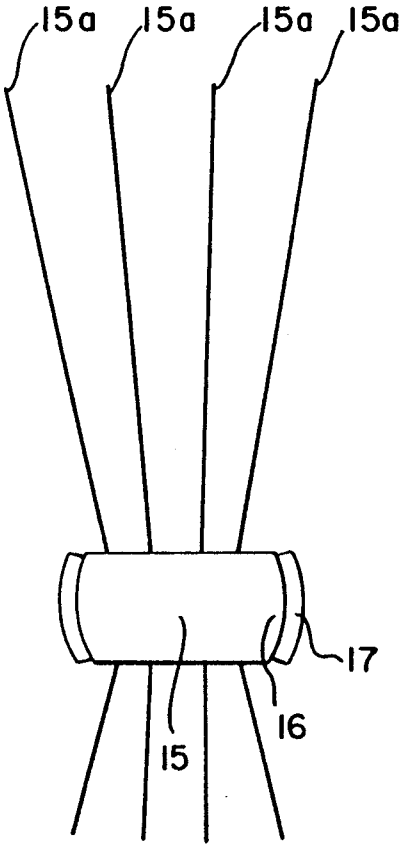
FIGS. 6*a*, 6*b* and 6*c* are side, and frontal views of a pleater device of the present invention.
Figure 6B:
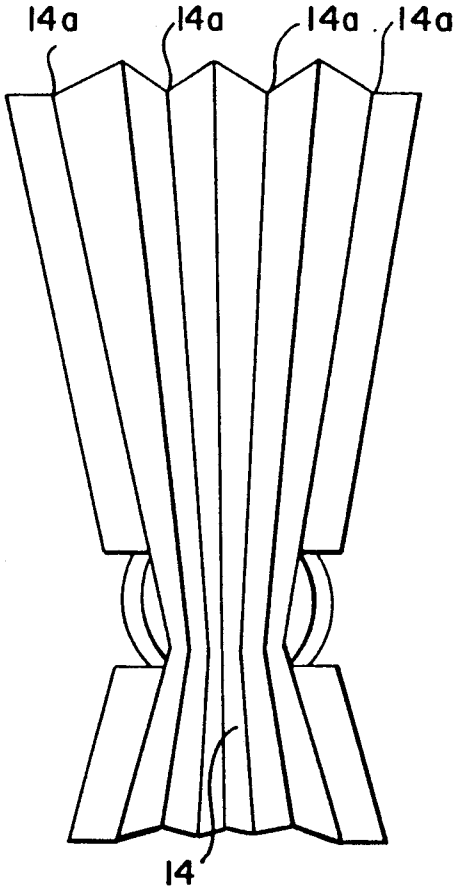
Figure 6A:
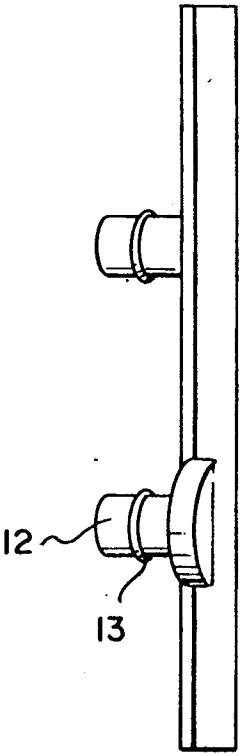

FIGS. 6*a*, 6*b* and 6*c* show a pleater device for use with the present invention. The pleater device comprises a pleater shaper 14 in which a fabric, such as a drapery fabric, is placed over the pleater shaper with the fabric being inserted in the grooves 14*a*. Pleater press 15 which includes wires 15*a*, anchors the drapery fabric onto the pleater shaper. The pleater press is covered with a pleater decorative center binder 16. Snap-on clips 17 are used to attach the decorative binder 16 to the pleater press and pleater form. The pleater shaper 14 include connector arm 12 and washer lock 13 so that the pleater arm structure can then be attached to material brace 2. When using the pleater forming structure, the connector arm does not pass through the fabric, but rather the fabric is held on the connector arm by the pleater device.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A glide frame apparatus for supporting a sheet material and adapted for movement along a rod member, said glide frame apparatus comprising:

(a) a frame means for mounting on and movement along a rod member, said frame means having a length and a width and said frame means including material brace means for adjusting one of said length or width of said frame means;

(b) at least one anchor means for being fixed to the sheet material and coupled to said frame means such that a portion of the sheet material is thereby attached to said frame means by said anchor means, wherein said frame means includes receiving means and wherein said anchor means includes coupling means having a ball member, said ball member being received and held in a socket member for attaching said anchor means to said frame means.

2. A glide frame apparatus as set forth in claim 7, wherein said frame means further includes cylindrical receiving means having a transverse slot therein, and wherein said anchor means further includes a cylindrical connector arm means having a washer lock thereon, said connector arm means being inserted into said receiving means such that said washer lock is engaged in said transverse slot when said anchor means is attached to said frame means.

3. A glide frame apparatus for supporting a sheet material and adapted for movement along a rod member, said glide frame apparatus comprising:

(a) a frame means for mounting on and movement along a rod member, said frame means having a length and a width and said frame means including material brace means for adjusting one of said length or width of said frame means;

(b) at least one anchor means for being fixed to the sheet material and coupled to said frame means such that a portion of the sheet material is thereby attached to said frame means by said anchor means, wherein said frame means includes cylindrical receiving means having a transverse slot therein, and wherein said anchor means includes a cylindrical connector arm means having a washer lock thereon, said connector arm means being inserted into said receiving means such that said washer lock is engaged in said transverse slot for attaching said anchor means to said frame means.

4. A glide frame apparatus for supporting a sheet material and adapted for movement along a rod member, said glide frame apparatus comprising:

(a) frame means for mounting on and movement along a rod member; said frame means including cylindrical receiving means having a socket means and a transverse slot therein; and (b) at least one anchor means for attachment to the sheet material, said anchor means having connector arm means having a ball means and a washer lock means thereon, wherein when said anchor means is attached to said frame means, said ball means is received and held in said receiving means and said washer lock is engaged in said transverse slot, whereby said anchor means with the sheet material attached thereto are attached to said frame means.

5. A glide frame apparatus for supporting a sheet material and adapted for movement along a rod member, said glide frame apparatus comprising:

(a) a frame means for mounting on and movement along a rod member, said frame means having a length and a width and said frame means including material brace means for adjusting one of said length or width of said frame means;

at least one anchor means for being fixed to the sheet material and coupled to said frame means such that a portion of the sheet material is thereby attached to said frame means by said anchor means wherein said frame means is adapted to be inserted into a rod pocket in the sheet material and said anchor means is outside of the rod pocket when fixed to the sheet material and wherein the movement of said frame means on the rod moves the sheet material with respect to the rod; and (c) a pleater device, said pleater device comprising pleater form means, pleater press means to anchor and form a portion of the sheet material to said pleater form means, and pleater binder means for engaging said anchor means and for holding said pleater press means and said pleater form means in engagement with the sheet material.

6. A glide frame apparatus as set forth in claim 5, wherein said material brace means includes extention arm means, said extention arm means being slidably mounted in said frame means for adjusting the one of said length of width.

7. A glide frame apparatus as set forth in claim 6, first engaging means on said frame means and second engaging means on said extention arm means, wherein said first engaging means engages said second engaging means for fixing the slidable mounting position of said extention arm means in said frame means.

8. A glide frame apparatus as set forth in claim 7, wherein said extention arm means includes spring means for contacting said frame means and biasing said material brace means away from said frame means.

9. A glide frame apparatus as set forth in claim 5, including bearing means mounted in said frame means for supporting said frame means on the rod, thereby facilitating movement of said frame means on the rod.

10. A glide frame apparatus as set forth in claim 9, wherein said bearing means are roller bearings.

11. A glide frame apparatus as set forth in claim 10, wherein said roller bearings are positioned on the top of said frame means.

12. A glide frame apparatus as set forth in claim 10, wherein said roller bearings are positioned on the top and bottom of said frame means.

13. A glide frame apparatus as set forth in claim 10, wherein said roller bearings are positioned on the sides of said frame means.

14. A glide frame apparatus as set forth in claim 13, wherein said roller bearings are positioned on upper and lower portions of the slides of said frame means, and wherein said roller bearings on the upper and lower portions are spring biased towards each other.

* * * * *